US008740298B2

(12) United States Patent
Kenttamaa-Squires et al.

(10) Patent No.: US 8,740,298 B2
(45) Date of Patent: Jun. 3, 2014

(54) CONVERTIBLE CHAIR

(75) Inventors: Leah Kenttamaa-Squires, West Lafayette, IN (US); Kyle Amick, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 168 days.

(21) Appl. No.: 13/370,659

(22) Filed: Feb. 10, 2012

(65) Prior Publication Data

US 2012/0274103 A1 Nov. 1, 2012

Related U.S. Application Data

(60) Provisional application No. 61/441,478, filed on Feb. 10, 2011.

(51) Int. Cl.
*A47C 13/00* (2006.01)

(52) U.S. Cl.
USPC ..... 297/129; 297/118

(58) Field of Classification Search
USPC ..... 297/118, 129
See application file for complete search history.

(56) References Cited

U.S. PATENT DOCUMENTS

| | | | | |
|---|---|---|---|---|
| 331,111 | A | 11/1885 | Batton | |
| 3,285,654 | A * | 11/1966 | Cramer | 297/35 |
| 3,997,213 | A * | 12/1976 | Smith et al. | 297/118 |
| 4,072,341 | A | 2/1978 | Kurz | |
| 4,792,181 | A | 12/1988 | Guichon | |
| 5,082,324 | A | 1/1992 | Harada et al. | |
| 5,110,183 | A | 5/1992 | Jeanes, III | |
| 5,356,160 | A * | 10/1994 | Urlwin | 280/30 |
| 5,669,659 | A * | 9/1997 | Dittmer | 297/129 |
| 5,779,248 | A * | 7/1998 | Gold et al. | 280/30 |
| 5,868,461 | A * | 2/1999 | Brotherston | 297/84 |
| 6,312,048 | B1 * | 11/2001 | Kilmer | 297/129 |
| 6,390,546 | B1 | 5/2002 | Ming | |
| 6,962,392 | B2 | 11/2005 | O'Connor | |
| 7,011,362 | B1 * | 3/2006 | Huang | 297/89 |
| 7,361,128 | B2 | 4/2008 | Chen | |
| 7,461,897 | B2 | 12/2008 | Kruse et al. | |
| 7,472,921 | B2 | 1/2009 | Harrison et al. | |

OTHER PUBLICATIONS

Invention could help dentist, doctors in developing countries, http;://www.purdue.edu/newsroom/research_park_foundation/2011/110616LeahChair.html, Jun. 16, 2011, 2 pages.

* cited by examiner

*Primary Examiner* — Sarah B McPartlin
(74) *Attorney, Agent, or Firm* — John V. Daniluck; Douglas G. Gallagher; Bingham Greenebaum Doll LLP

(57) ABSTRACT

A convertible chair with upright and reclined configurations is disclosed. Embodiments of the invention include a chair that collapses to form a dolly and expands to form a chair with upright and reclined seating configurations. Alternate embodiments include a base connected to a seat with a four bar linkage. In still further embodiments, one side of the four bar linkage is extended outside the pivoting joints, the extended portion being pivotally and slidingly engaged with the base. In other embodiments, the chair is configured to maintain the occupant's center of mass near the primary weight supporting pivot linkage.

27 Claims, 9 Drawing Sheets

CONVERTIBLE CHAIR

This application claims the benefit of U.S. Provisional Application No. 61/441,478, filed Feb. 10, 2011. The entirety of which is hereby incorporated herein by reference.

FIELD

Various embodiments described herein pertain to a chair that is convertible into different positions and configurations, and some embodiments pertain to a foldable chair that is convertible into a wheeled dolly.

BACKGROUND

Chairs are used by various healthcare providers to examine and treat patients. Many chairs provide upright and reclined configurations to give patients easy access and healthcare providers orientations appropriate for various examinations and treatments.

SUMMARY

Embodiments of the present invention provide an improved convertible chair.

In accordance with a first aspect of embodiments of the present invention, a convertible chair that converts from a dolly adapted to carry a payload, such as healthcare equipment, to an examination chair transitions from an upright configuration to a reclined configuration requiring little effort from the healthcare provider to transition between these two configurations. Features of various embodiment include locating the mechanism for transitioning the chair from upright to reclined configurations in a position that is easily accessed by the healthcare provided but not by the patient/occupant. Embodiments include a sliding and pivoting linkage connecting the chair's seat to the base.

Features of other embodiments include the maintenance of the horizontal position of the patient's center of mass near the primary weight supporting pivot linkage, reducing the effort required by the healthcare provider to transition the chair between the upright and reclined configurations.

Other embodiments include a four bar linkage, the vertices of which form a quadrilateral with lengths between the vertices having proportions of approximately 21 to 7.5 to 20.8 to 7.1. These ratios can accommodate a wide range of patients while providing ergonomically correct upright and reclined angles at the knee and waist.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein is not necessarily intended to address every object described herein, and each embodiment does not necessarily include each feature described. Other forms, embodiments, objects, advantages, benefits, features, and aspects of the present invention will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions or may have been created from scaled drawings. However, such dimensions, or the relative scaling within a figure, are by way of example, and not to be construed as limiting.

DETAILED DESCRIPTION OF THE ILLUSTRATED EMBODIMENTS

Figure 1:
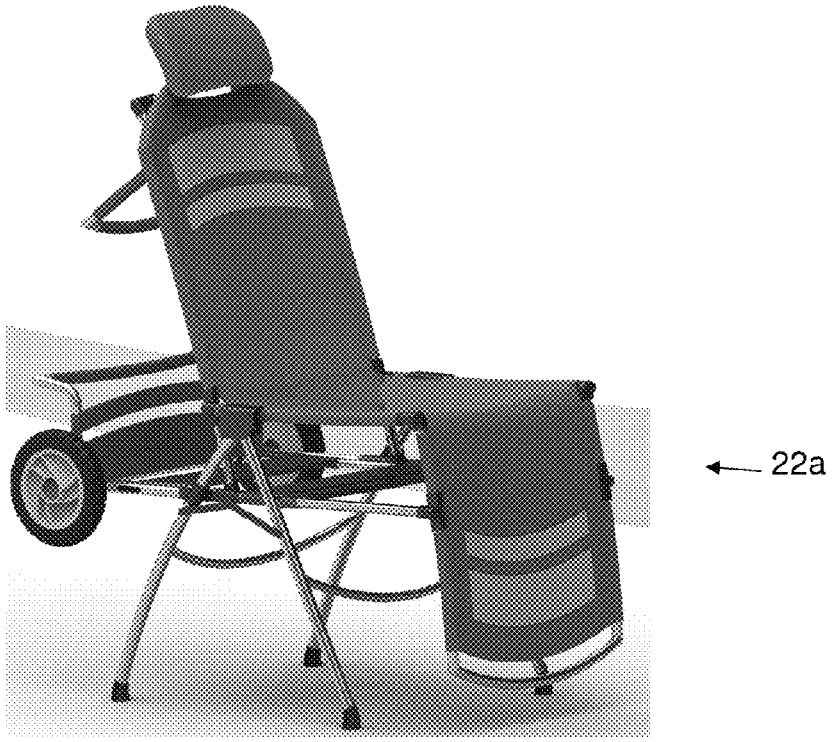
FIG. 1 is a front, right-side perspective and shaded representation of an apparatus in the upright mode according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended; any alterations and further modifications of the described or illustrated embodiments, and any further applications of the principles of the invention as illustrated herein are contemplated as would normally occur to one skilled in the art to which the invention relates. At least one embodiment of the invention is shown in great detail, although it will be apparent to those skilled in the relevant art that some features or some combinations of features may not be shown for the sake of clarity.

Any reference to "invention" within this document is a reference to an embodiment of a family of inventions, with no single embodiment including features that are necessarily included in all embodiments, unless otherwise stated. Furthermore, although there may be references to "advantages" provided by some embodiments of the present invention, other embodiments may not include those same advantages, or may include different advantages. Any advantages described herein are not to be construed as limiting to any of the claims.

The use of an N-series prefix for an element number (NXX.XX) refers to an element that is the same as the non-prefixed element (XX.XX), except as shown and described thereafter. As an example, an element 1020.1 would be the same as element 20.1, except for those different features of element 1020.1 shown and described. Further, common elements and common features of related elements are drawn in the same manner in different figures, and/or use the same symbology in different figures. As such, it is not necessary to describe the features of 1020.1 and 20.1 that are the same, since these common features are apparent to a person of ordinary skill in the related field of technology.

Specific quantities (spatial dimensions, temperatures, pressures, times, force, resistance, current, voltage, concentrations, wavelengths, frequencies, heat transfer coefficients, dimensionless parameters, etc.) may be used explicitly or implicitly herein, such specific quantities are presented as examples only and are approximate values unless otherwise indicated. Discussions pertaining to specific compositions of matter, if present, are presented as examples only and do not limit the applicability of other compositions of matter, especially other compositions of matter with similar properties, unless otherwise indicated.

Some embodiments of the present invention pertain to an apparatus that is capable of having multiple configurations and uses. In one embodiment, the apparatus can be configured as a chair in one mode, and converted into a dolly for transporting cargo in a second mode. In some embodiments the apparatus is adapted and configured for use with a healthcare professional, such as a dentist. However, in yet other embodiments the apparatus is adapted and configured for recreational use, such as a seat for watching a sporting event that can be converted into a dolly for transporting a beverage cooler or other cargo to and from the sporting event.

In yet other embodiments, there is an apparatus that is convertible among three different positions, such as a first position for a chair in a fully reclined configuration, a second mode for a chair in an upright configuration, and a third mode as a two-wheeled dolly for transporting cargo. In some of those embodiments adapted and configured for recreational use, the apparatus includes arm rests. In some embodiments, the arm rests are separable from apparatus 20, such as those embodiments in which the arm rests are stored (in the dolly mode) onto one or more of the legs of the chair support. In the chair configuration, these arm rests can be separated from their temporary restraints and easily coupled into the braces of the seat bottom.

Figure 2:
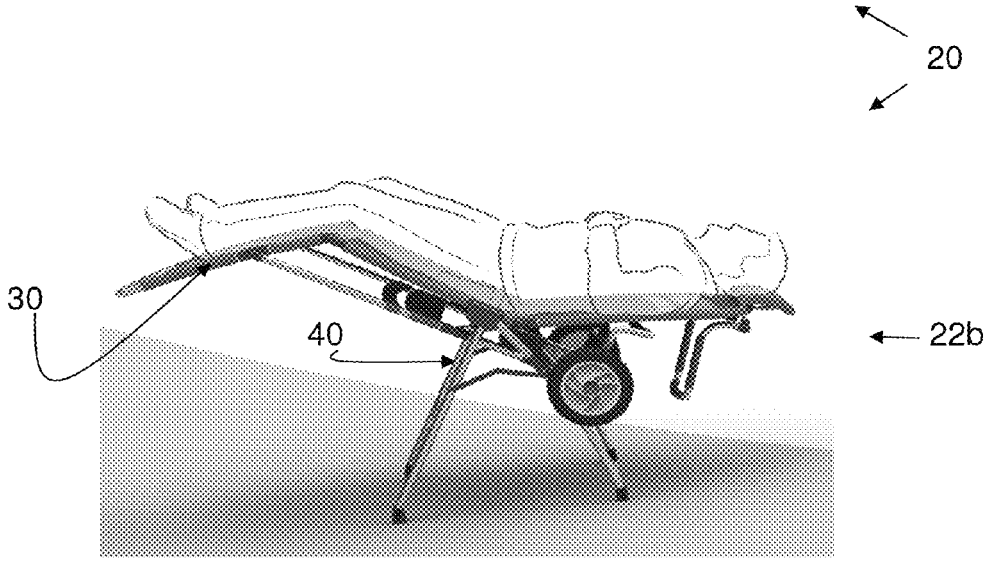
FIG. 2 is a left side elevational and shaded representation of the apparatus of FIG. 1 in the fully reclined position.

FIGS. 1 and 2 show right side and left side views, respectively of an apparatus 20 according to one embodiment of the present invention. FIG. 1 shows apparatus 20 configured as an upright chair 22*a*. FIG. 2 shows apparatus 20 configured as a fully reclined chair 22*b*. FIG. 2 includes a sketch of a person situated on the reclined chair 22*b*. In some embodiments, the seat assembly 30 is supported by a base (for example, chair support assembly 40) that is positioned such that the chair support is substantially vertically aligned with (substantially underneath in the illustrated embodiment) the center of mass of the person occupying the chair. Such placement makes it easier to rotate the chair from the reclined position 22*b* to the upright position 22*a* and vice versa.

Figure 3:
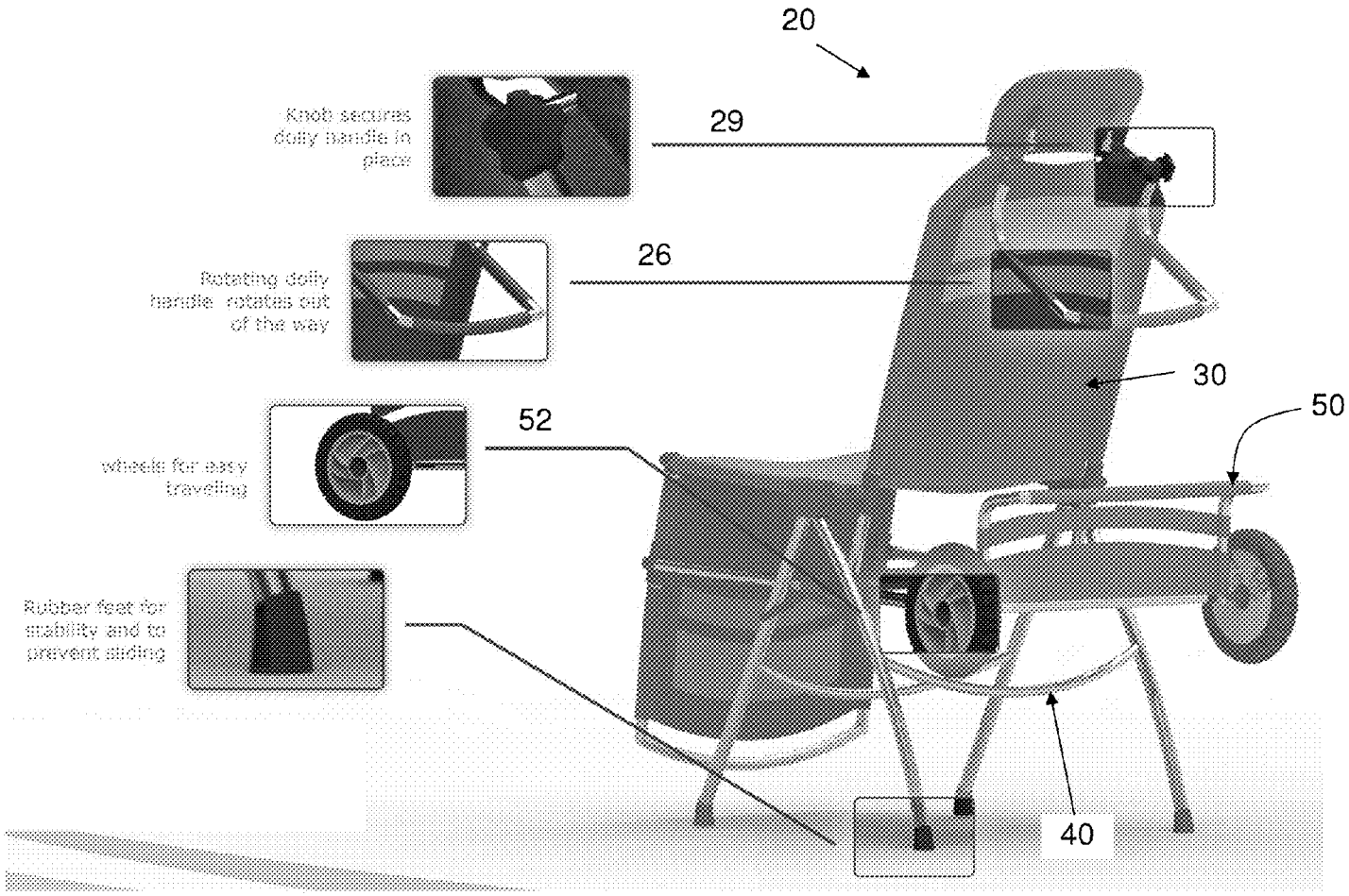
FIG. 3 is a left side, rear and shaded representation of the apparatus of FIG. 1, with certain aspects of the apparatus described and also shown in clipped-out views.
Figure 4:
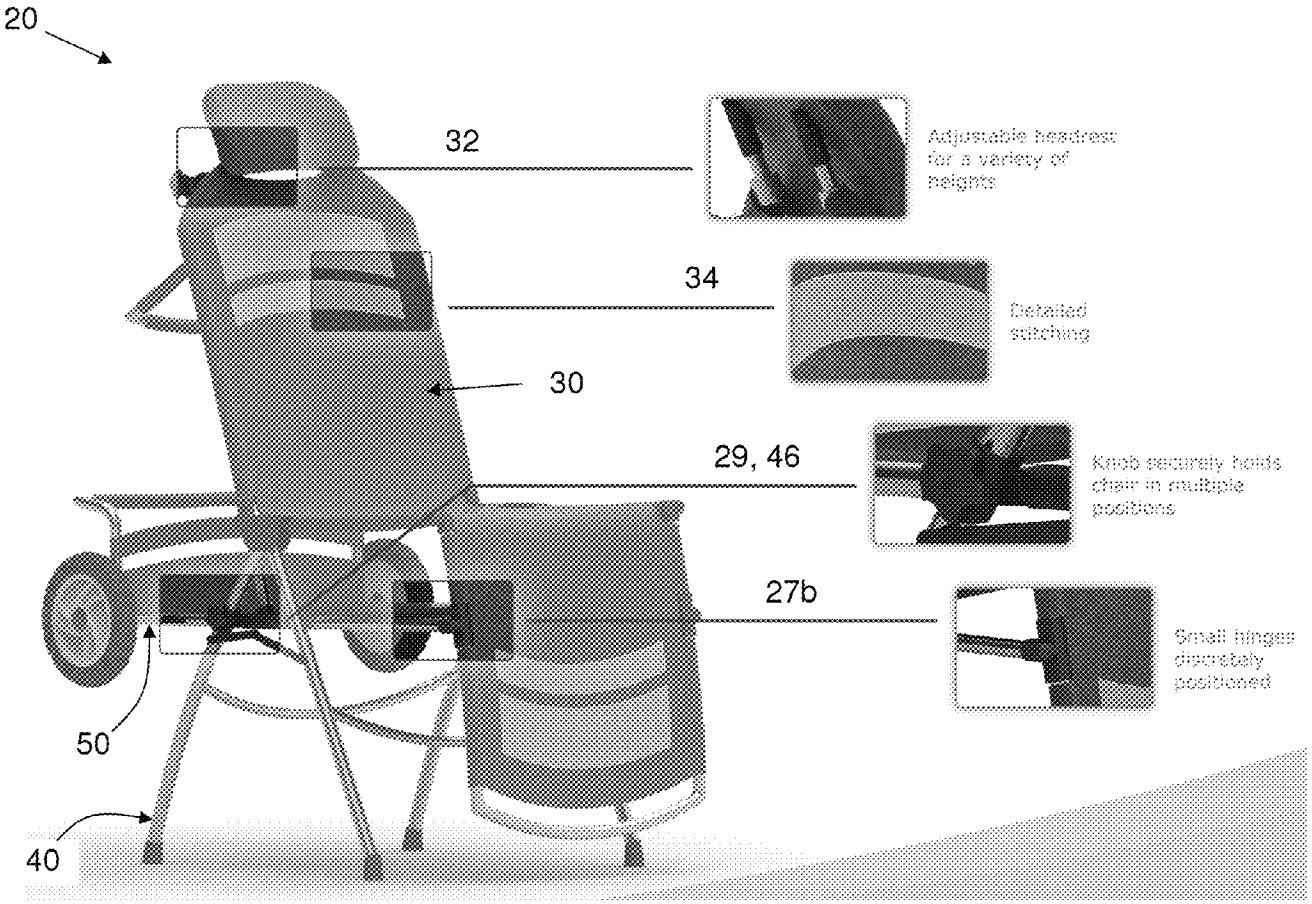
FIG. 4 is a right side, front and shaded representation of the apparatus of FIG. 1, with certain aspects of the apparatus described and also shown in clipped-out views.

FIGS. 3 and 4 show apparatus 20 in the upright position 22*a*. Apparatus 20 includes a chair section 30 that is supported from the floor by a chair support assembly 40. Apparatus 20 further includes a dolly support assembly 50 that is coupled to both chair 30 and chair support 40. As best seen in FIG. 3, apparatus 20 includes an upper handle 26 pivotally coupled to seat 30, and lockable in place by a locking mechanism such as a frictionally-securing knob 29. Dolly support 50 includes a pair of wheels 52 coupled by an axle for transporting apparatus 20 in the dolly mode 24. Chair support 40 includes rubber feet or the like on chair support 40 to prevent sliding of apparatus 20 on the floor.

Referring to FIG. 4, seat 30 includes a headrest 32 that can be adjusted to a variety of heights in order to accommodate different sizes of occupants. The seat back 34 of seat assembly 30, in some embodiments, includes decorative detailed stitching. Apparatus 20 further includes one or more securement knobs 29 that coact with a combination pivoting and sliding joint 46 in order to lock dolly support assembly 50 relative to chair support 40. Locking mechanism 29 is a locking mechanism that is spring-loaded to place a pin within a receptacle along the length of a dolly support brace. In some embodiments, the forwardmost position of pivoting/sliding joint 46 is established by sliding contact into a physical stop located along the length of the dolly support brace. Further, apparatus 20 include a plurality of pivoting joints 27*a*, 27*b*, and 27*c* that couple multiple braces to each other and permit at least limited rotation of one brace relative to another brace. The term "brace" refers to a structural member constructed of any cross sectional shape and from any type of material. As will be shown and described herein, the various braces are often located at the sides of the chair 30 or dolly 50. In one embodiment, the braces are fabricated from stainless steel tubing.

Figure 6:
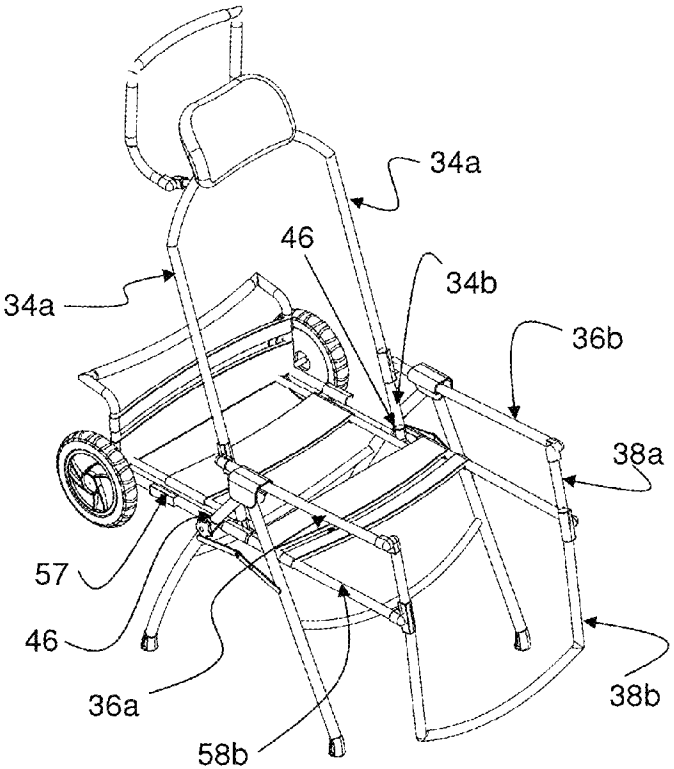
FIG. 6 shows the apparatus of FIG. 7, except with the seat back covering and seat bottom covering removed to show additional details.
Figure 5:
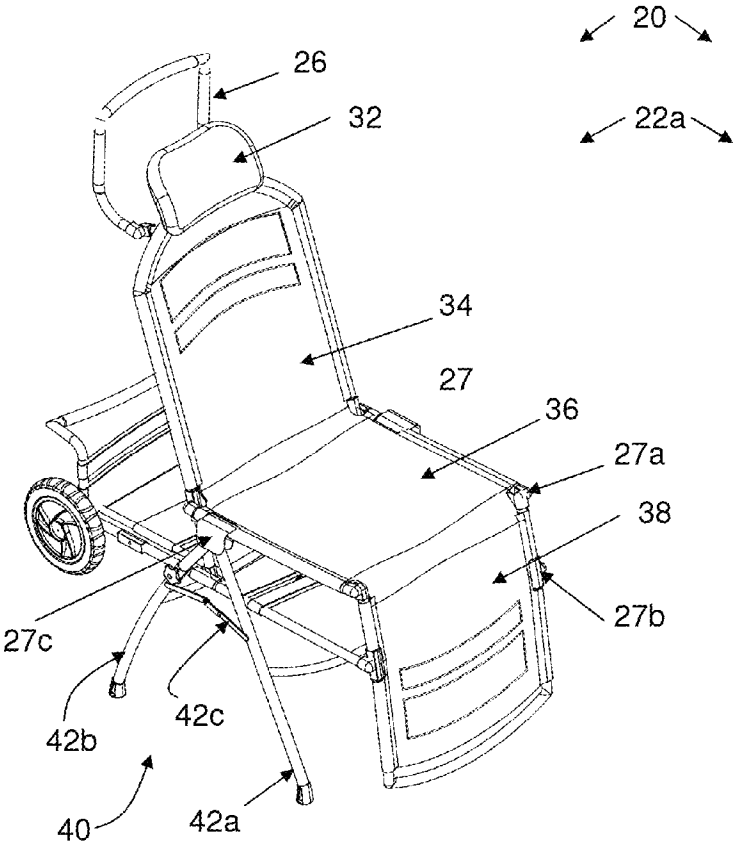
FIG. 5 is a front, right and top side perspective unshaded perspective representation of an apparatus according to one embodiment of the present invention.

FIGS. 5 and 6 show apparatus 20 in the seated upright chair mode 22*a*. Seat assembly 30 includes a headrest 32 that extendible in position relative to a seat back 34. Further, headrest 32 may be pivotal relative to seat back 34. Seat back 34 is pivotally coupled to a seat bottom 36, which likewise is pivotally coupled to a leg support platform 38. It appreciated that apparatus 20 is substantially symmetric about a centerline, with apparatus on one side of the centerline being either identical to or mirror images of the corresponding apparatus on the other side of the centerline.

In some embodiments, a flexible, fabric seat back extends across a pair of upper side braces 34*a* and 34*b*, and provides a location against which the occupant places his back. Likewise, an optionally flexible member 36 extends across seat bottom side braces 36*a* and 36*b* to support the bottom of the person. An optionally flexible member 38 extends across right and left leg supports 38 (as best seen in FIG. 6). In some embodiments, the leg side braces include an upper side brace 38*a* that is fixedly coupled through a pivoting joint 27*b* to a lower brace 38*b*.

FIGS. 5 and 6 further show a support assembly 40 that supports chair 30 from the floor. Chair support assembly 40 includes right and left pairs of legs. The tops of legs 42*a* and 42*b* are pivotally coupled to each other at a pivoting joint 27*c*. Joint 27*c* further includes a channel to receive seat bottom side braces 36, the channel being optionally offset inboard from the pivotal coupling to the legs. A tension brace, for example multi-piece folding tension brace 42*c*, is coupled to both forward leg 42*a* and aft leg 42*b*. In the illustrated embodiment, multi-piece folding tension brace 42*c* is pivotally coupled to forward leg 42*a* and aft leg 42*b*, although other embodiments include tension braces that are not pivotally coupled to legs 42*a* and 42*b*, such as flexible woven or fabric type braces. A forward static brace 44*a* couples together the pair of forward legs, and a corresponding aft static brace 44*b* couples together the aft pair of legs.

Figure 7:
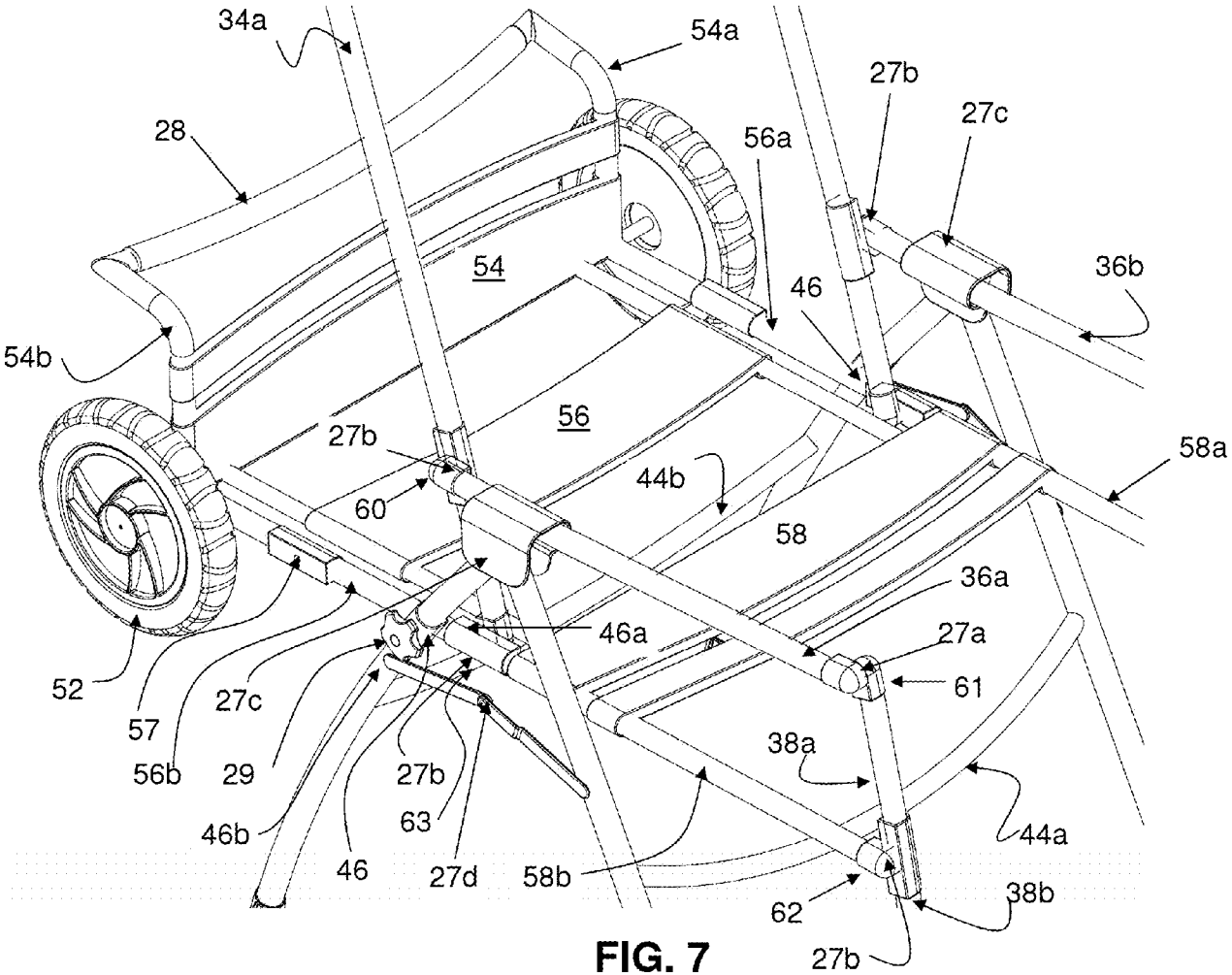
FIG. 7 is an enlarged portion of FIG. 8.

Some embodiments of apparatus 20 further include a dolly support assembly 50 that is pivotally coupled to both leg support 38 and seat back 34, and pivotally/slidingly coupled to support assembly 40. As best seen in FIG. 7, dolly support 50 includes a cargo support and lower handle 28 that is fixedly coupled to a pair of right and left lower side braces 56*a* and 56*b*. Lower side braces 56*a* and 56*b* are fixedly coupled to upper side braces 58*a* and 58*b* by pivot joints 27*a* and 27*b*, respectively. Note that these pivot joints permit pivoting of seat back side braces 34*a* and 34*b* relative to dolly side braces 56*a*, 56*b*, 58*a* and 58*b*.

In some embodiments at least one dolly side brace 56*a*/56*b* is slidingly coupled to a combination sliding/pivoting joint 46. As will be discussed later, dolly support 50 can be slid to an aftmost position to establish upright position 22*a* (see FIG. 1). Dolly support 50 can be slid to a forwardmost position to establish the reclined configuration 22*b* (see FIG. 2). In the reclined configuration, locking mechanism 29 is coupled into a receptacle 57 located along the length of dolly side braces 56*b* and/or 56*a*.

A dolly bottom support 54, which is optionally flexible, extends across bottom support brackets 54*a* and 54*b* of handle 28, and provides a platform to support cargo when apparatus 20 is in the dolly mode 24. Further, dolly lower back support 56 (which is optionally flexible) extends across dolly support braces 56*a* and 56*b*, and dolly upper back support 58 (which is optionally flexible) extends across dolly side braces 58*a* and 58*b*, both of these back supports being adapted and configured to support the weight of cargo in the dolly mode 24. In yet other embodiments, there is a cover 25 that can be installed on apparatus 20 in the dolly mode 24, this cover providing a surface for resting of cargo, and at the same time protecting the seat 30 from staining or other damage.

Figure 9:
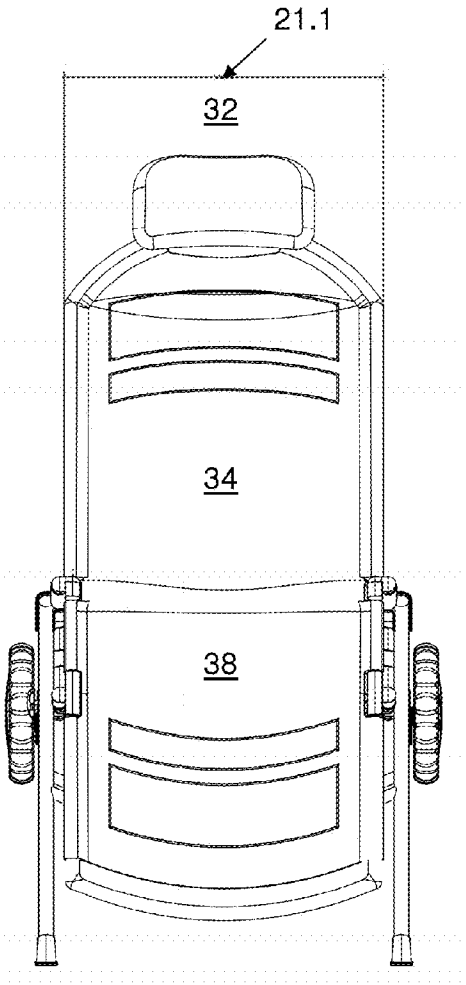
FIG. 9 is a scaled, front plan view of the apparatus of FIG. 10 showing with an exemplary dimension.
Figure 8:
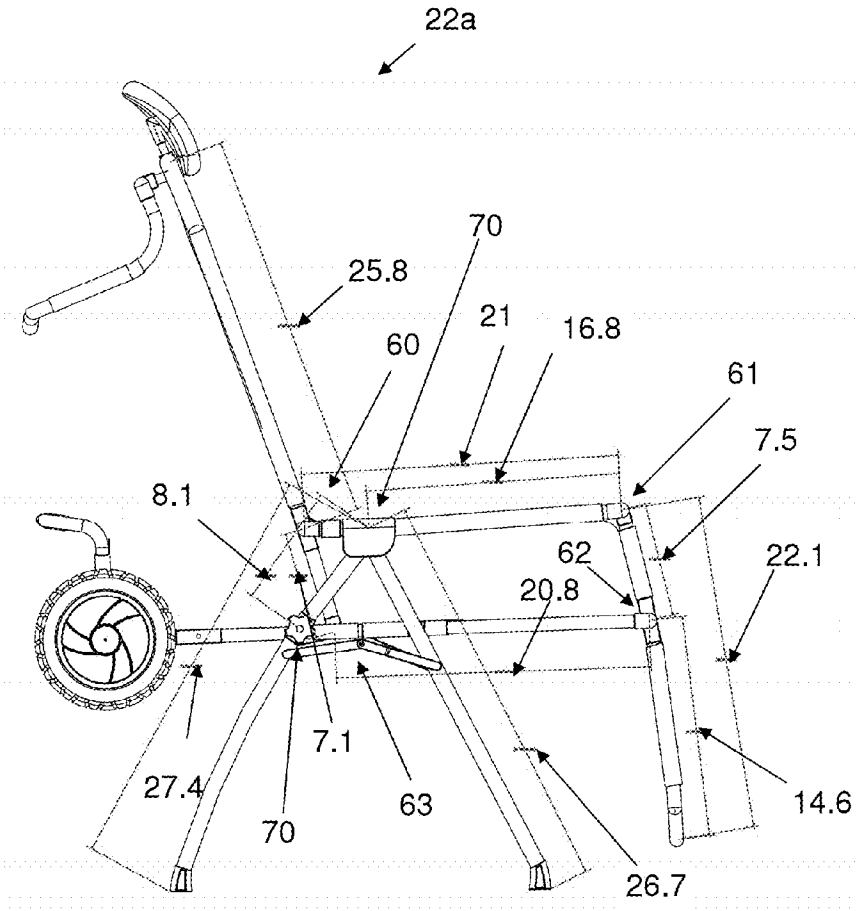
FIG. 8 is a scaled, side elevational view of the apparatus of FIG. 7 shown with exemplary dimensions.

FIGS. 8 and 9 present a set of dimensions (in inches) for some features of apparatus 20 according to one embodiment of the present invention. It is appreciated that these dimensions are by way of example only and are not to be construed as limiting on any claimed inventions unless explicitly expressed as such.

As seen in FIGS. 7 and 8, pivot locations 60, 61, 62 and 63 form the vertices of a four bar linkage (which defines a quadrilateral), the relative lengths between the vertices having proportions of 21 to 7.5 to 20.8 to 7.1. The ratio of the distances between vertices on two opposing sides of the four bar linkage are 21/20.8 (approximately 1.01) and the ratio of the distances between vertices of the other two opposing sides of the four bar linkage are 7.5/7.1 (approximately 1.06). Alternate embodiments include apparatuses with a ratio of the distance between vertices of two opposing sides of the four bar linkage being 1.01+/−15% and the ratio of the distances between vertices of the other two opposing sides of the four bar linkage being 1.06+/−15%. Other embodiments include apparatuses with a ratio of the distance between vertices of two opposing sides of the four bar linkage being 1.01+/−10% and the ratio of the distances between vertices of the other two opposing sides of the four bar linkage being 1.06+/−10%. And still further embodiments include apparatuses with a ratio of the distance between vertices of two opposing sides of the four bar linkage being 1.01+/−5% and the ratio of the distances between vertices of the other two opposing sides of the four bar linkage being 1.06+/−5%.

Alternate embodiments include apparatuses with different absolute lengths between pivot locations 60 and 61, 61 and 62, 62 and 63, and 63 and 61 than those depicted in FIG. 8, and in particular have different absolute lengths that maintain the same approximate proportions to those depicted in FIG. 8. It should be appreciated that at least one embodiment includes pivot locations forming the vertices of a parallelogram (opposing sides of equal length).

In some embodiments of the present invention there are multiple types of pivoting joints that provide both a pivoting function and/or an offsetting function. Referring to FIG. 7, there can be seen a first type of pivot joint 27*a* that couples upper leg brace 38*a* to a seat side brace 36*a*. The pivoting function occurs generally at the connection of the ends of the braces. Further, there is optionally an offsetting function, such that seat side brace 36*a* is offset (offset in an outboard direction in the illustrated embodiment) relative to the inboard location of upper leg brace 38*a*.

The leg support braces 38*a*/38*b* are pivotally coupled to dolly upper side brace 58*b* by a second type of pivoting joint 27*b*. Joint 27*b* optionally includes an offset feature, which offsets dolly side brace 58*b* from the leg support braces 38*a* and 38*b*. In the illustrated embodiment, the dolly side brace 58*b* is offset to the outboard of the inboard-positioned leg support braces 38*a* and 38*b*. However, it can be seen that in addition to this optional outboard/inboard offsetting feature of joint 27*b*, joint 27*b* further includes provision for pivotally coupling the end of brace 58*b* to a location other than the end of the leg support braces. As shown in FIG. 7, the inboard portion of joint 27*b* has extending from it in fixed relation to each other an upper leg support brace 38*a* and a lower leg support brace 38*b*. However, in yet other configurations, the two separate braces 38*a* and 38*b* are combined into a single leg side brace, and the single leg brace extends through joint 27*b*. In such an alternative configuration, there is also a means to lock the position of brace 27*b* relative to the leg support braces.

In the illustrated embodiment, the inboard/outboard offsetting features of joints 27*a* and 27*b* facilitate the folding of apparatus 20 into dolly mode 24. For example, in FIG. 7 it can be seen that the seat back side braces 34*a* and 34*b* are located inboard of the seat bottom side braces 36*a* and 36*b* and the dolly side braces 58*a* and 58*b*. Further, the leg support side braces 38*a* and 38*b* are located inboard of the seat bottom side braces 36*a* and 36*b* and the dolly side braces 58*a* and 58*b*. A forward pivot joint 27*b* establishes the upper dolly side braces 58 to be outboard of the leg support braces 38. A second aftward pair of pivot joints 27*b* further couple the dolly side braces 58 to be outboard of, and pivotally coupled to, the seat back side braces 34.

Referring again to FIG. 7, which depicts apparatus 20 in an upright position, the horizontal position of the aft dolly pivot joints (the pivot joints 27*b* connecting the dolly side braces 58 (and 56) to the seat back side braces 34) is relatively close to (near) the horizontal position of the aft seat pivot joints (the pivot joints 27*b* connecting the seat back side braces 34 to the seat bottom side braces 36).

The horizontal location of the occupant's center of mass is located near the horizontal position of pivot location 70, at which side braces 36*a* and 36*b* connect to chair support 40 via a pivoting joint 27*c*. In the illustrated embodiment, pivot location 70 is located on or inside the quadrilateral formed by vertices 60, 61, 62 and 63. When reclined (e.g., in reclining mode 22*b*), the horizontal position of the occupant's center of mass is also near the horizontal location at which side braces 36*a* and 36*b* connect to chair support 40. In some embodiments, the horizontal position of the occupant's center of mass is maintained within 4 inches of the horizontal position of pivot location 70 as the apparatus 20 transitions from upright to reclined positions. In other embodiments, the horizontal position of the occupant's center of mass is maintained within 2 inches of the horizontal position of pivot location 70 as the apparatus 20 transitions from upright to reclined positions. In still further embodiments, the horizontal position of the occupant's center of mass is maintained within 1 inch of the horizontal position of pivot location 70 as the apparatus 20 transitions from upright to reclined positions.

As apparatus 20 transitions from upright to reclined, the horizontal position of the occupant's center of mass remains near the horizontal location at which side braces 36*a* and 36*b* connect to chair support 40, resulting in relatively little force being required to transition between the positions and making apparatus 20 easy to use.

The coupling together of the seat assembly 30, chair support 40 and dolly support 50 is illustrated in detail in FIG. 7. As stated previously, dolly support 50 is pivotally coupled to seat assembly 30 by a pivot joint 27*b* that is midway along the leg support braces 38 and at a pivot joint 27*b* that is at the end of the seat back side braces 34.

Dolly support 50 is slidingly coupled to chair support 40 at pivot location 71 by right and left combination joints 46. Each combination joint 46 can include a passageway 46*a* through which extend the dolly side braces 56. Each combination joint 46 includes a pivot joint 46*b* that couples to the aft leg of each leg pair 42*a*/42*b*. Optionally, joints 46 are adapted and configured to place the dolly side braces 56 inboard of the leg pairs 42. Therefore, both seat assembly 30 and dolly support 50 rotate about the lower outboard pivot joints 46*b*, and are both contained between and inboard of leg pairs 42.

A locking mechanism inhibits dolly side braces 56 from sliding within combination joints 46. In the example embodiment depicted in FIG. 7, a locking mechanism 29 includes a spring-loaded pin attached to an external knob handle. The seated upright mode 22 is established when the dolly lower side supports 56*a* and 56*b* are slid to an aft position relative to chair support 40. This position is established by having one or more locking pin receptacles located along the length of the dolly side braces 56. Locating the pin of locking mechanism 29 within a locking pin receptacle creates a physical stop for dolly side braces 56, inhibiting the sliding of dolly side braces 56 within combination joint 46 and locking dolly support 50 in a position relative to chair support 40. Upright positioning may also be established by locking mechanism 29 abutting a physical stop located along at least one dolly side braces 56, or by locking mechanism 29 contacting at least one aft dolly pivot joint 27*b*. In the illustrated embodiment, the locking mechanism 29 is located outside the quadrilateral formed by the vertices 60, 61, 62 and 63 of the four bar linkage discussed above.

Dolly support side brace 56 optionally includes one or more second receptacles 57 that establish a reclined position 22*b* when the pin of locking mechanism 29 is received within the receptacle 57.

Figure 10:
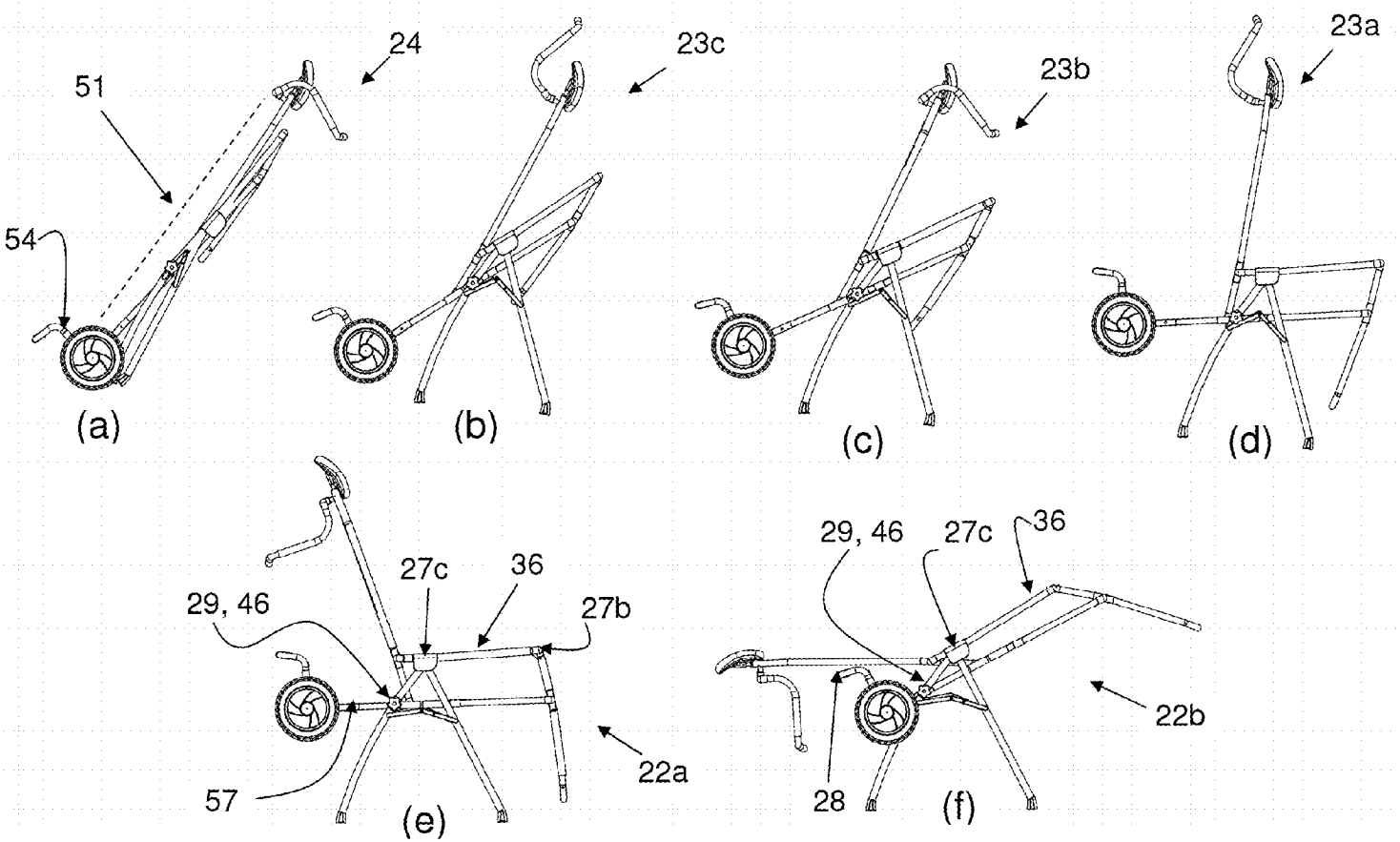
FIG. 10(*a*) through FIG. 10(*f*) shows an apparatus according to one embodiment of the present invention transitioning from a folded, dolly mode to a fully reclined chair mode, all of the views being side elevational views.
Figure 11:
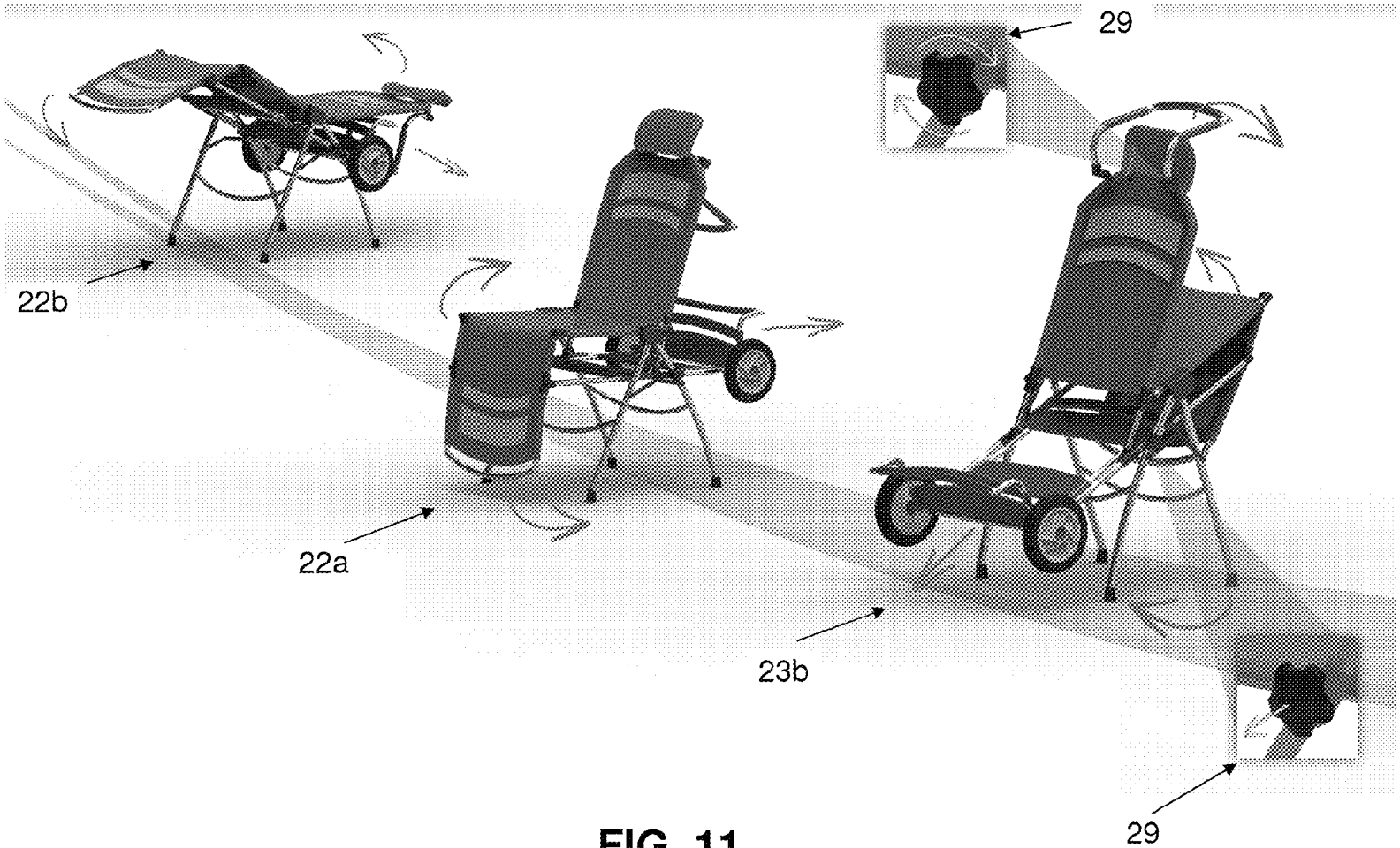
FIG. 11 shows the apparatus of FIG. 2 transitioning to the configuration of FIG. 1, and finally to an intermediate folded position, according to one embodiment of the present invention.
Figure 12:
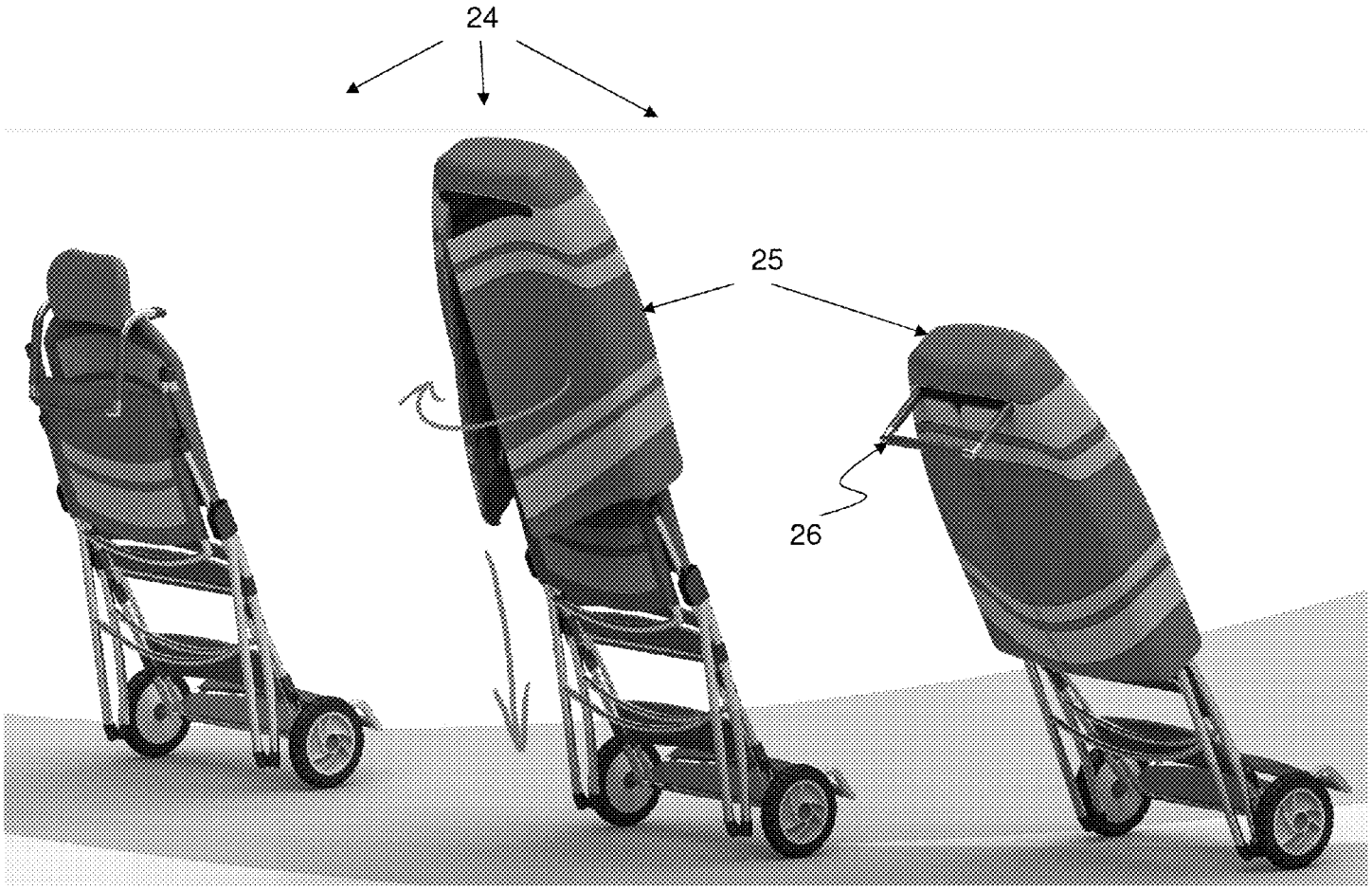
FIG. 12 shows the transition of an apparatus according to another embodiment of the present invention in the dolly mode from an uncovered to a covered configuration.

FIGS. 10, 11, and 12 depict apparatus 20 transitioning from the chair mode 22 to the dolly mode 24 according to one embodiment of the present invention. FIG. 10(*f*) shows apparatus 20 in the fully reclined mode 22*b*. Lower handle 28 has been pushed forward and inward of leg pair 42, and locking mechanism 29 has been latched within receptacle 57. This places the seat back 34 in a substantially horizontal orientation, and elevates the legs of the chair occupant above the occupant's head.

FIG. 10(*e*) shows apparatus 20 in the seated upright chair mode 22*a*. To achieve this orientation from the orientation depicted in FIG. 10(*f*), the latching mechanisms 29 have been pulled out of receptacles 57, and handle 28 pulled toward the rear (to the left in the figure). In so pulling on handle 28, the leg support 38 is rotated downwards by the pivot coupling 27*b* connecting the forward end of dolly side braces 58*a*/58*b* to the leg support braces 38*a*/38*b*. During this transition from position 22*b* to position 22*a*, dolly side braces 56 slide aft within combination joint 46. The pivoting connection between dolly support 50 and seat back 34 (the aft dolly pivot joint 27*b*) results in an upward and forward motion of the seat back when transitioning to the upright chair mode 22*a*. When the appropriate upright orientation 22*a* is achieved, locking mechanism 29 inhibits the sliding of side braces 56 within combination joint 46, such as by a locking pin being positioned within a locking pin receptacle on dolly side brace 56 or by joint 46 contacting a physical stop, such as aft dolly pivot joint 27*b*.

FIGS. 10(*d*), (*c*), and (*b*) show intermediate folding modes 23*a*, 23*b*, and 23*c*, respectively, of apparatus 20. FIG. 10(*a*) shows the fully folded dolly mode 24 of apparatus 20. It can be seen that the various braces and flexible supports establish an irregular plane 51, against which cargo may rest. The weight of the cargo is also supported by the bottom side braces 54 of handle 28.

FIG. 11 shows several of the positions from FIG. 10, except with arrows added to indicate various relative movements.

FIG. 12 shows an alternate embodiment in which a cover 25 can be attached over the top of apparatus 20 in the dolly mode 24. Cover 25 includes a split back portion that is left open when cover 25 is slid downward over the top of the dolly. When fully installed, the cover back flaps are rejoined to each other (such as by Velcro). In some embodiments there is a slot in the cover 25 that permits extension of handle 26 for ease of use of the dolly.

While examples, representative embodiments and specific forms of the invention have been illustrated and described in detail in the drawings and foregoing description, the same is to be considered as illustrative and not restrictive or limiting. The description of particular features in one embodiment does not imply that those particular features are necessarily limited to that one embodiment. Features of one embodiment may be used in combination with features of other embodiments as would be understood by one of ordinary skill in the art, whether or not explicitly described as such. Exemplary embodiments have been shown and described, and all changes and modifications that come within the spirit of the invention are desired to be protected.

What is claimed is:

1. A chair, comprising:

a seat including four seat members pivotally connected to one another at four seat pivot locations, the four seat pivot locations forming the vertices of a four bar linkage;

a base pivotally connected to the seat at two base pivot locations, one of the base pivot connections being selectively securable to one of the four seat members at two or more locations along the length of the seat member; and two dolly wheels connected to the seat member to which the base pivot connection selectively secures.

2. The chair of claim 1, wherein the seat pivot locations are located at positions different from the base pivot locations.

3. The chair of claim 1, wherein the base is pivotally connected to two seat members.

4. The chair of claim 3, wherein one base pivot location is positioned on or inside the quadrilateral formed by the four seat pivot locations.

5. The chair of claim 4, wherein one base pivot location is positioned outside the quadrilateral formed by the four seat pivot locations.

6. The chair of claim 3, wherein one base pivot location is positioned outside the quadrilateral formed by the four seat pivot locations.

7. The chair of claim 1, wherein the four seat members are rigid.

8. The chair of claim 1, wherein the distances between the four seat pivot locations are proportionally equal to approximately 7.1 to 21 to 7.5 to 20.8.

9. The chair of claim 1, wherein a ratio of the distances between the seat pivot locations on two opposing sides of the four bar linkage are 1.01+/−10% and the ratio of the distances between vertices of the other two opposing sides of the four bar linkage are 1.06+/−10%.

10. The chair of claim 1, wherein the selectively securable base pivot connection slidingly receives the seat member to which the base pivot connection selectively secures.

11. The chair of claim 1, further comprising:

an upright configuration for seating a person in an upright position defined by the selectively securable base pivot connection being secured to the one seat member at a first location; and a reclined configuration for seating a person in a reclined position defined by the selectively securable base pivot connection being secured to the one seat member at a second location different from the first location.

12. The chair of claim 11, further comprising:

a dolly configuration for rolling movement of a payload supported above a surface with the two dolly wheels and defined by the base pivot connection being secured to the one seat member at a third location different from the first and second locations.

13. The chair of claim 11, wherein the chair is transitioned from the upright configuration to the reclined configuration by increasing the distance between the seat pivot locations associated with the seat member to which the base pivot connection selectively secures and the selectively securable base pivot connection.

14. The chair of claim 1, further comprising:

an upright configuration for seating a person in an upright position; and a reclined configuration for seating a person in a reclined position;

wherein the sides of the quadrilateral formed by the vertices of the four bar linkage have the same length in the upright configuration as in the reclined configuration.

15. The chair of claim 1, wherein a seat pivot location is collocated with a base pivot location.

16. A convertible chair for supporting a person, comprising:

a base;

a seat connected to the base, the seat including a seat bottom and a seat back;

a wheeled member connected to the base;

an upright configuration with the base configured to rest on a support surface with the seat bottom oriented approximately parallel to the support surface and the seat back oriented upright with respect to the support surface;

a reclined configuration with the base configured to rest on the support surface with the seat back oriented approximately parallel to the support surface; and a dolly configuration with the seat and the base collapsed to form a cargo carrying surface offset from the support surface by the wheeled member;

wherein the wheeled portion of the wheeled member is positioned behind the seat back in the upright configuration, and wherein the wheeled member moves forward when the chair transitions from the upright configuration to the reclined configuration.

17. The convertible chair of claim 16, wherein the wheeled member forms part of a four bar linkage.

18. The convertible chair of claim 17, wherein a ratio of the distances between the vertices of two opposing sides of the four bar linkage are 1.01+/−10% and the ratio of the distances between the vertices of the other two opposing sides of the four bar linkage are 1.06+/−10%.

19. The convertible chair of claim 16, further comprising:

a pivoting linkage connecting the wheeled member and the base, the pivoting linkage slidingly engaging the wheeled member and being adjustable to selectively engage the wheeled member along a length of the wheeled member.

20. The convertible chair of claim 16, wherein the seat bottom is inclined to raise the occupant's knees above the occupant's hips in the reclined configuration.

21. The convertible chair of claim 20, further comprising:

a foot rest oriented approximately perpendicular to the support surface in the upright configuration and oriented approximately parallel to the support surface in the reclined configuration.

22. A convertible chair for supporting a person, comprising:

a base;

a seat connected to the base, the seat including a seat bottom and a seat back;

a wheeled member connected to the base;

an upright configuration with the base configured to rest on a support surface with the seat bottom oriented approximately parallel to the support surface and the seat back oriented upright with respect to the support surface;

a reclined configuration with the base configured to rest on the support surface with the seat back oriented approximately parallel to the support surface;

a dolly configuration with the seat and the base collapsed to form a cargo carrying surface offset from the support surface by the wheeled member; and a pivoting linkage connecting the wheeled member and the base, the pivoting linkage slidingly engaging the wheeled member and being adjustable to selectively engage the wheeled member along a length of the wheeled member.

23. The convertible chair of claim 22, wherein the wheeled member forms part of a four bar linkage.

24. The convertible chair of claim 23, wherein a ratio of the distances between the vertices of two opposing sides of the four bar linkage are 1.01+/−10% and the ratio of the distances between the vertices of the other two opposing sides of the four bar linkage are 1.06+/−10%.

25. The convertible chair of claim 22, wherein the wheeled portion of the wheeled member is positioned behind the seat back in the upright configuration, and wherein the wheeled member moves forward when the chair transitions from the upright configuration to the reclined configuration.

26. The convertible chair of claim 22, wherein the seat bottom is inclined to raise the occupant's knees above the occupant's hips in the reclined configuration.

27. The convertible chair of claim 26, further comprising:

a foot rest oriented approximately perpendicular to the support surface in the upright configuration and oriented approximately parallel to the support surface in the reclined configuration.

* * * * *